US007025116B2

(12) United States Patent
Suzuki et al.

(10) Patent No.: US 7,025,116 B2
(45) Date of Patent: Apr. 11, 2006

(54) MOLD AND METHOD OF MOLDING METALLIC PRODUCT

(75) Inventors: Hideyuki Suzuki, Kariya (JP); Koichiro Sato, Kariya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/629,472

(22) Filed: Jul. 29, 2003

(65) Prior Publication Data

US 2004/0020628 A1 Feb. 5, 2004

(30) Foreign Application Priority Data

Aug. 1, 2002 (JP) ..... 2002-225172

(51) Int. Cl.
*B22D 17/00* (2006.01)

(52) U.S. Cl. ..... 164/312; 164/342

(58) Field of Classification Search ..... 164/312, 164/342, 343, 314

See application file for complete search history.

(56) References Cited

U.S. PATENT DOCUMENTS

| | | | | |
|---|---|---|---|---|
| 3,959,433 | A * | 5/1976 | Sauers | 264/328.6 |
| 4,798,237 | A * | 1/1989 | Nakano | 164/255 |
| 4,986,335 | A * | 1/1991 | Koch | 164/312 |
| 6,250,365 | B1 * | 6/2001 | Flemings et al. | 164/113 |
| 6,460,596 | B1 * | 10/2002 | Yamaguchi et al. | 164/72 |

FOREIGN PATENT DOCUMENTS

JP 2001-018229 1/2001

* cited by examiner

*Primary Examiner*—Len Tran
(74) *Attorney, Agent, or Firm*—Harness, Dickey & Pierce, PLC

(57) ABSTRACT

A mold M for molding a metallic product including a fixed mold section 2 and a movable mold section 1, wherein heating means 7 is provided in the fixed mold section and cooling means 10 is provided in the movable mold section, which means are controlled by a temperature control device 14 so that any desired temperature is obtainable. Also, as the heating and the cooling of the mold are not repeated, but the fixed mold section is always heated and the movable mold section is always cooled, it is possible to shorten the cycle times.

11 Claims, 2 Drawing Sheets

MOLD AND METHOD OF MOLDING METALLIC PRODUCT

BACKGROUND OF THE INVENTION

1. Field of the Invention

The present invention relates to a mold and method for molding a metallic product capable of easily controlling the temperature of a molten metal during and after the filling of the molten metal into a cavity.

2. Description of the Related Art

There is a prior art disclosed in Japanese Unexamined Patent Publication No. 2001-18229 entitled "Mold for Molding Synthetic resin and Device and Method for Controlling Mold Temperature". In this prior art, to easily switching the heating and the cooling of a cavity surface of the mold, a liner having a flow path is provided in a mold base, so that a hot medium is made to flow in the flow path when the molten resin is injected, on one hand, and a coolant is made to flow in the flow path thereafter to solidify a product molded within the mold, on the other hand.

When the material to be molded is synthetic resin, as an environment in which the resin is not solidified can be maintained at a temperature in a range from 200 to 250° C., it is possible to increase and reduce the mold temperature in a relatively short time. However, when the material is a metal or a metallic alloy such as magnesium alloy having a high melting point of approximately 600° C., it is necessary to increase the mold temperature to 600° C. or higher for the purpose of maintaining the molten state of the material. To do so, a long time such as, for example, from 30 minutes to 1 hour is required even if a powerful heater is used.

Also, when the temperature is reduced to approximately 300° C. at which the release of a molded product from the mold is possible after the molten magnesium alloy has been filled in the mold and solidified, a long time is necessary to increase the temperature to prepare for the next operation. Thus, when the metal is molded, it is very difficult to repeat the heating and cooling in a short time, whereby the above-mentioned prior art is not practically applicable to the production of metallic molded products.

SUMMARY OF THE INVENTION

The present invention has been made to solve the above-mentioned problems in the prior art, and an object thereof is to provide a mold and a method for molding a metallic product, capable of restricting the transfer of heat from the molten material to the mold during the filling of the molten metal into the mold to ensure the fluidity thereof on one hand, and accelerating the transfer of heat after the molten metal has been filled in the mold on the other hand.

According to one aspect of the present invention, the fixed mold section of the mold is provided with heating means and the movable mold section is provided with cooling means, both of which means are controlled by temperature control means, respectively, so that the temperature variations in one cycle of the fixed and movable mold sections are individually controllable. Thereby, it is possible to heat the fixed mold section even if the mold is in an open state to shorten the cycle time of the molding operation. Also, it is possible to heat the fixed mold section side to a higher temperature to ensure the sufficient fluidity of the molten metal to be filled.

According to the inventive mold, the fixed mold section is disposed on the injection side of molten metal to be molded, and ejector pins for releasing a molded metallic product from the movable mold section are provided in the movable mold section. Thereby, while ensuring the sufficient fluidity of the molten metal, the lowering of the temperature of the movable mold section side is enhanced. As a result, the removal of the molded product by the ejector pins is accelerated.

According to the inventive mold, when the mold is in an open state, the temperature of the fixed mold section rises to a value in a range from 300 to 700° C., and the temperature of the movable mold section is controlled to a value in a range from a solidifying point of the metal to be molded to 0° C. Thereby, it is possible to increase the temperature of the fixed mold section and to reduce that of the movable mold section when the mold is in an open state.

According to another aspect of the present invention, a method for molding a metallic product is provided which comprises the steps of heating the fixed mold section by the heating means and cooling the movable mold section by the cooling means when the mold is open; closing the mold during the heating of the fixed mold section and the cooling of the movable mold section, heating the fixed mold section by the heating means and cooling the movable mold section by the cooling means even after the mold has been closed; injecting the molten metal into the cavity when the temperature of the fixed mold section has reached the predetermined uppermost value and that of the movable mold section has reached the predetermined lowermost value; continuing the cooling of the movable mold section and opening the mold when the mold temperature falls to a value at which the molded metallic product is releasable from the mold; and removing the molded product from the mold. Thereby, as the heating of the fixed mold section and the cooling of the movable mold section can be carried out when the mold is in the open state, it is possible to shorten the cycle time of the molding operation. Also, as the injection is carried out at the highest temperature of the fixed mold section, it is possible to ensure the fluidity of the molten metal sufficient for filling the same in the cavity. Further, as the temperature of the molded metal product promptly falls to a level at which it is releasable of the mold by cooling the movable mold section, it is-possible to shorten the cycle time.

The present invention may be more fully understood from the description of the preferred embodiments of the invention, as set forth below, together with the accompanying drawings.

DESCRIPTION OF THE PREFERRED EMBODIMENTS

Figure 1:
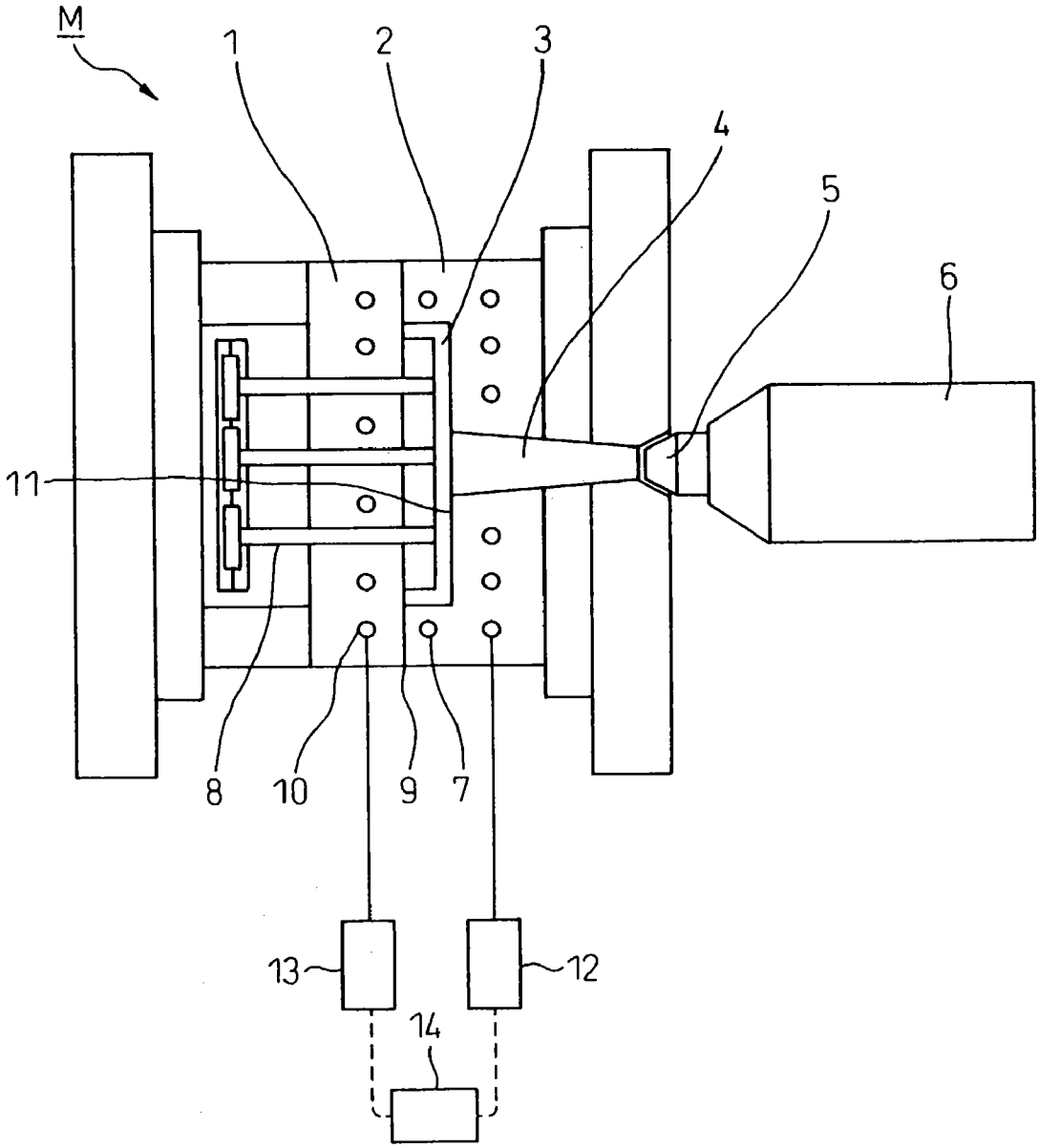
FIG. 1 is an elevational sectional view of one embodiment of a mold for molding a metallic product according to the present invention.

One embodiment of a mold for a metallic product and a method for controlling the mold temperature according to the present invention will be described below with reference to the attached drawings. FIG. 1 is an elevational sectional view of one embodiment of the inventive mold for molding a metallic product. A device for molding a metallic product has a mold M for molding a metallic product constituted by a movable mold section 1 and a fixed mold section 2. This mold M defines a cavity 3 for molding a metal such as magnesium alloy by clamping the movable mold section 1 and the fixed mold section 2.

The movable mold section 1 is provided with a motorized or hydraulic mold-driving mechanism (not shown) for advancing/returning it relative to the fixed mold section 2. Accordingly, when the movable mold section 1 advanced, the mold M is closed and, when returned, the mold M is open. Also, ejector pins 8 are provided in the movable mold section 1 for removing a molded product from the mold M. By the operation of an ejector pin-driving mechanism (not shown), the ejector pins 8 are moved and projected from the movable mold section 1 to release the molded product from the movable mold section 1.

Further, cooling means 10 is embedded in the movable mold section 1. This cooling means 10 includes a cooling path to allow coolant to flow therethrough so that the coolant is fed from a coolant source 13 by a command issued from a temperature control device 14.

A runner 4, communicated with the cavity 3 at one end, is provided in the fixed mold section 2, and the other open end, thereof is coupled to an injection mechanism 6 via an injection nozzle 5. A screw or a plunger (not shown) is disposed within the injection mechanism 6, so that molten metal is conveyed by the screw (plunger) and injected into the cavity 3 from the injection nozzle 5.

Heating means is embedded in the fixed mold section 2. This heating means 7 may be a heating path for letting a heating medium flow therethrough, or the wiring of an electric heater. Also, other known heating types may be employed. The heating means 7 operates by supply (of a heating medium or electric current) from a heating medium source 12 in accordance with a command issued from the temperature control device 14. Accordingly, the temperature of the mold M can be set at an optional value by the temperature control device 14.

Next, a method for molding a metallic product using the above-mentioned mold will be described below. First, the heating means 7 is operated while the mold M is open to increase the temperature of the fixed mold section 2 to a value in a range from 300 to 700° C., and to reduce the temperature of the movable mold section 1 to a value in a range from a solidifying point to 0° C.

Then, the mold-driving mechanism is operated to close the mold M and prepare for the injection of molten metal. At this time, the heat transfer begins from the fixed mold section 2 to the movable mold section 1, mainly through a parting surface 9 which is a contact surface of the fixed mold section 2 with the movable mold section 1. On the other hand, the heat transfer from a surface 11 of the cavity 3 for molding the molded product is suppressed by the heat insulation of air within the cavity.

As a result, upon the injection of molten metal from the, injection mechanism 6, the temperature of the surface 11 in the cavity 3 is higher on the fixed mold section side and lower on the movable mold section side, whereby it is possible to fill the molten metal in the cavity 3 while ensuring a sufficient fluidity thereof.

As a space of the cavity 3 is full of metal when the filling of the cavity 3 with molten metal has been completed, an abrupt heat transfer begins from the fixed mold section 2 to the movable mold section 1 to lower the temperature of the molded product in a short time to a level capable of releasing the same from the mold. In this case, the lowering of the temperature is accelerated by suitably operating the cooling means 10 provided in the movable mold section 1 by the temperature control device 14.

When the temperature of the molded product has been lowered to a level at which it is releasable from the mold, the movable mold section 1 is returned to open the mold M and simultaneously therewith to project the ejector pins 8 from the movable mold section 1 by the action of the ejector pin-driving mechanism. Thus, the molded product is removed from the mold.

Figure 2:
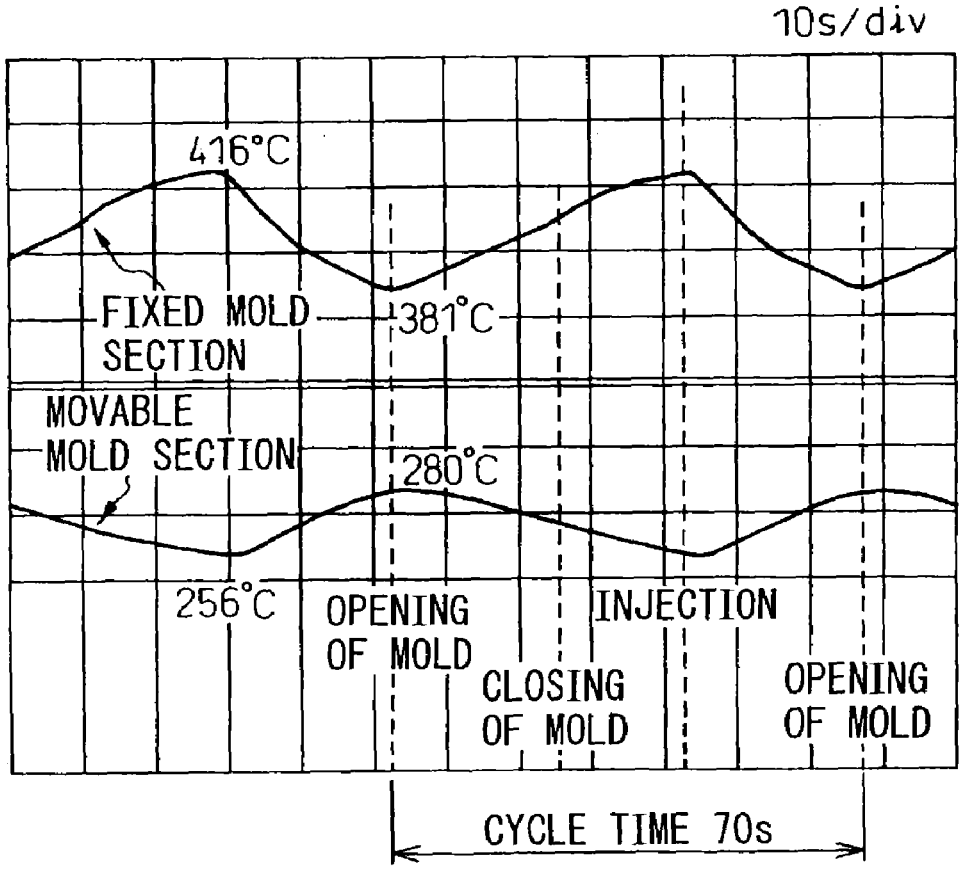
FIG. 2 is graphs showing the temperature variations in a fixed mold and a movable mold section, respectively, according to an embodiment of the inventive molding method.

FIG. 2 contains graphs showing the temperature variations in the fixed mold section 2 and the movable mold section 1, respectively, according to the embodiment of the inventive molding method. A vertical axis of the graph represents the temperature and a horizontal axis thereof represents the time (S). The upper graph shown by a solid line represents the temperature variation in the fixed mold section 2, while the lower graph shown by a solid line represents the temperature variation in the movable mold section 1. One block of the horizontal axis is 10 seconds. In FIG. 2, the mold is open when the fixed mold section 2 is at the lowermost temperature (approximately 381° C.) in the temperature variation and the movable mold section 1 is the uppermost temperature (approximately 280° C.), and closed during the temperature rising phase of the fixed mold section 2 and the temperature lowering phase of the movable mold section 1. Then, the injection is carried out when the fixed mold section 2 is at the highest temperature (approximately 416° C.) in the temperature variation and the movable mod section 2 is at the lowest temperature (approximately 256° C.) in the temperature variation. After the injection, when the temperature of the fixed mold section 2 falls and that of the movable mold sectional rises so that temperature of the fixed mold section 2 reaches approximately 381° C. (the lowest temperature) at which the molded product is releasable from the mold, the mold is open again,. In this case, one cycle of the molding process requires approximately 70 seconds.

As is apparent from the graphs, according to the present invention, the fixed mold section 2 is heated by the heating means 7 and movable mold section 1 is cooled by the cooling means 10 when the mold is in an open state, so that the temperature difference of approximately 160° C. is obtained upon the injection. After the injection, the quantity of heat in the fixed mold section 2 is transferred to the movable mold section 1 due to a high heat-conductive characteristic of the metal filled in the cavity 3, and the temperature of the fixed mold section falls, while the temperature of the movable mold section 1 rises. When the mold is open and the molded product is removed from the cavity 3, the heat transfer between the fixed mold section 2 and the movable mold section 1 ceases, whereby the temperature of the fixed mold section 1 rises and that of the movable mold section 2 falls.

Accordingly, as the fluidity of the molten metal is sufficiently ensured in the present invention, it is possible to form a thin-walled case of 0.43 mm thick, used, for example, for a portable telephone, with metallic alloy such as magnesium alloy.

While the invention has been described by reference to specific embodiments chosen for purposes of illustration, it should be apparent that numerous modifications could be made thereto by those skilled in the art without departing from the basis concept and scope of the invention.

What is claimed is:

1. A mold for molding a metallic product, the mold comprising:

a fixed mold defining a fixed cavity, the fixed cavity defining a first portion of the metallic product;

a movable mold defining a movable cavity, the movable cavity defining a second portion of the metallic product, the movable mold being movable with respect to the fixed mold to allow removal of the metallic product;

the fixed mold section is provided with only heating means and the movable mold section is provided with only cooling means, both means being controlled by temperature control means, respectively, so that temperature variations of the fixed and movable mold sections are individually controllable;

the fixed mold section is disposed on an injection side of molten metal to be molded; and the temperature control means controls the temperature of the movable mold section in a range from a solidifying point of the molten metal to 0° C. when the mold is open and controls the temperature of the fixed mold section higher than the temperature of the movable mold section when the mold is open.

2. A mold for molding a metallic product as defined by claim 1, wherein ejector pins for releasing a molded metallic product from the movable mold section are provided in the movable mold section.

3. A mold for molding a metallic product as defined by claim 1, wherein the temperature of the fixed mold section rises to a value in a range from 300 to 700° C.

4. A mold for molding a metallic product as defined by claim 1, wherein the temperature control means controls the temperatures of the movable mold section and the fixed mold section such that the temperature of the fixed mold section reaches a predetermined highest value and that of movable mold section reaches a predetermined lower value when the molten metal is injected into the cavity, and the temperature of the mold falls to a value at which the molded metallic product is releasable from the mold when opening the mold.

5. A mold for molding a metallic product as defined by claim 4, wherein the temperature control means repeats the sequence of the temperature control.

6. A mold for molding a metallic product as defined by claim 1, wherein the temperature control means (1) heats the fixed mold section by the heating means and cools the movable mold section by the cooling means when the mold is open, (2) enables the mold to be closed during the heating of the fixed mold section and the cooling of the movable mold section, (3) heats the fixed mold section by the heating means and cools the movable mold section by the cooling means even after the mold has been closed, (4) enables the molten metal to be injected into the cavity when the temperature of the fixed mold section has reached the predetermined highest value and that of the movable mod section has reached the predetermined lowest value, (5) continues the cooling of the movable mold section and enables the mold to be opened when the mold temperature falls to the value at which the molded metallic product is releasable from the mold, and (6) enables the molded metallic product to be removed from the mold.

7. A mold for molding a metallic product as defined by claim 6, wherein the temperature control means repeats the sequence of the temperature control.

8. A mold for molding a metallic product as defined by claim 1, wherein the fixed mold section is in direct contact with the movable mold section when the mold is closed.

9. A mold for molding a metallic product as defined by claim 1, wherein the temperature control means controls the temperature of the fixed mold section to allow the metallic product to be released from the mold when the mold is closed.

10. A mold for molding a metallic product, the mold comprising:

a stationary mold disposed on an injection side of molten metal to be molded;

means for increasing the temperature of the stationary mold, the temperature increasing means being the only temperature control device associated with the stationary mold;

a movable mold movable with respect to the stationary mold;

means for decreasing the temperature of the movable mold, the temperature decreasing means being the only temperature control device associated with the movable mold;

means for controlling the temperature increasing means and the temperature decreasing means such that the movable mold is maintained at a temperature between a solidifying point of the molten metal to 0° C. when the mold is open and the stationary mold is maintained at a temperature higher than the temperature of the moveable mold.

11. A mold for a metallic product according to claim 10, wherein the controlling means controls the temperature increasing means to allow the metallic product to be released from the mold when the mold is closed.

* * * * *